US009673571B2

(12) United States Patent
Higashi et al.

(10) Patent No.: US 9,673,571 B2
(45) Date of Patent: Jun. 6, 2017

(54) SHIELD UNIT

(71) Applicant: YAZAKI CORPORATION, Tokyo (JP)

(72) Inventors: Junya Higashi, Shizuoka (JP); Yusuke Yanagihara, Shizuoka (JP); Takashi Ishihara, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/057,205

(22) Filed: Mar. 1, 2016

(65) Prior Publication Data

US 2016/0181735 A1 Jun. 23, 2016

Related U.S. Application Data

(63) Continuation of application No. PCT/JP2014/074432, filed on Sep. 16, 2014.

(30) Foreign Application Priority Data

Sep. 17, 2013 (JP) ..... 2013-191340

(51) Int. Cl.
*H01R 9/03* (2006.01)
*H01R 13/6593* (2011.01)
*H01R 9/05* (2006.01)

(52) U.S. Cl.
CPC ..... *H01R 13/6593* (2013.01); *H01R 9/0521* (2013.01)

(58) Field of Classification Search
CPC ..... H01R 13/5213; H01R 13/645; H01R 13/6456; H01R 13/625; H01R 13/6593; H01R 9/0521
See application file for complete search history.

(56) References Cited

U.S. PATENT DOCUMENTS 3,701,011 A * 10/1972 Biagi ..... G01R 21/00 324/103 P
5,505,637 A * 4/1996 Kramer ..... H01R 13/6593 439/467

(Continued)

FOREIGN PATENT DOCUMENTS

JP H03-86577 U 9/1991
JP 2006-228463 A 8/2006

(Continued)

OTHER PUBLICATIONS

The Office Action issued on Jan. 10, 2017 in the counterpart Japanese patent application.

*Primary Examiner* — Jean F Duverne
(74) *Attorney, Agent, or Firm* — Mots Law, PLLC

(57) ABSTRACT

A shield unit includes: a braid having a contact portion arranged in contact with a cylinder of a shield shell; a holder inserted in the cylinder and attached to the cylinder in contact with the contact portion, the holder attached to the cylinder electrically connecting the shield shell to the braid; and a rotation unit provided between the cylinder and the holder, the rotation unit being configured to make the holder rotate in a circumferential direction of the cylinder and make the cylinder and the contact portion slide relatively to each other until completion of attaching the holder to the cylinder.

20 Claims, 8 Drawing Sheets

(56) References Cited

U.S. PATENT DOCUMENTS

| | | | | |
|---|---|---|---|---|
| 5,895,291 | A * | 4/1999 | Furio | H01R 9/032 439/607.41 |
| 5,993,266 | A | 11/1999 | Mayer et al. | |
| 6,116,945 | A * | 9/2000 | Davis | H01R 13/5825 439/354 |
| 7,287,992 | B2 * | 10/2007 | Chawgo | H01R 13/447 439/135 |
| 9,040,822 | B2 * | 5/2015 | Nieto Lopez | H02G 1/00 174/138 F |
| 9,219,329 | B2 * | 12/2015 | Murphy | H01R 13/567 |
| 9,325,113 | B2 * | 4/2016 | Pankau | H01R 13/6272 |
| 2012/0028500 | A1 | 2/2012 | Lee et al. | |
| 2012/0156911 | A1 * | 6/2012 | Smith | H01R 35/04 439/323 |
| 2013/0168150 | A1 * | 7/2013 | Sakakura | H02G 3/22 174/650 |

FOREIGN PATENT DOCUMENTS

| | | | |
|---|---|---|---|
| JP | 2008-288020 | A | 11/2008 |
| JP | 2008-288021 | A | 11/2008 |
| JP | 2012-521068 | A | 9/2012 |
| WO | 97/16871 | A1 | 5/1997 |
| WO | 2010/107197 | A3 | 9/2010 |

* cited by examiner

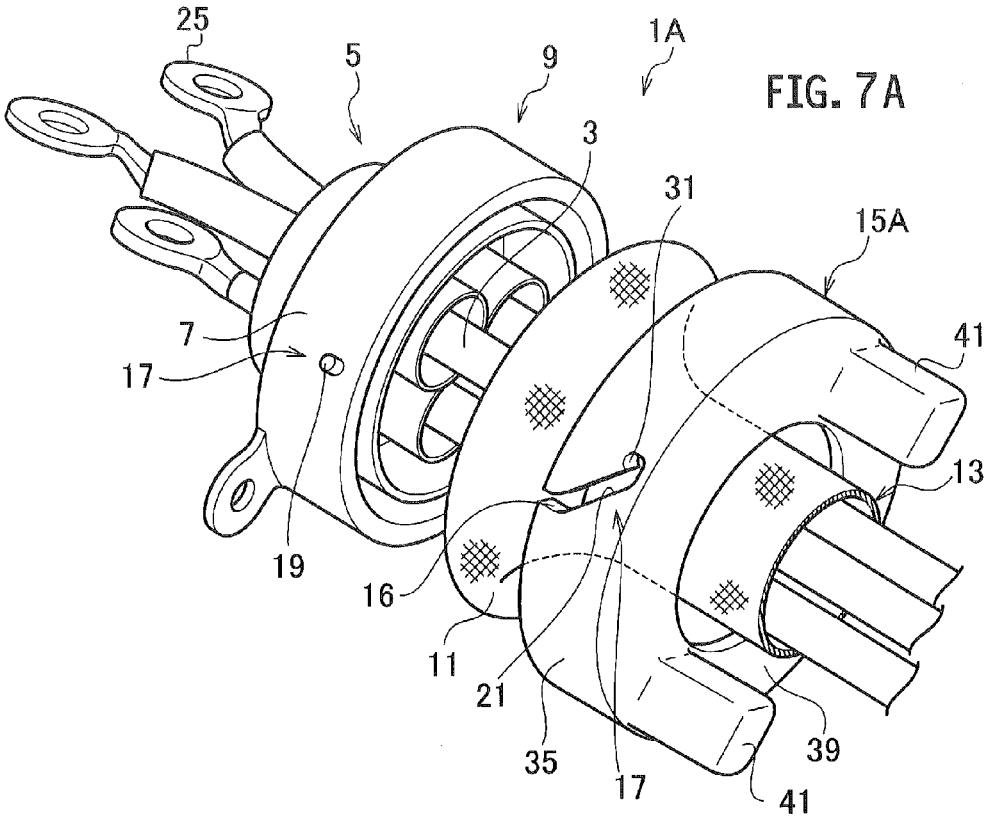
FIG. 7A
FIG. 7B
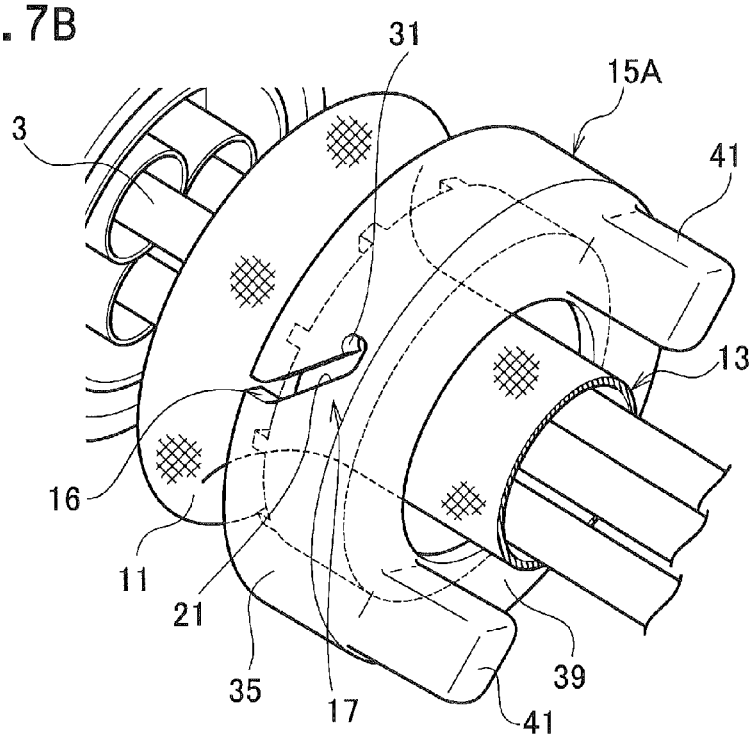

SHIELD UNIT

CROSS REFERENCE TO RELATED APPLICATION

This application is a Continuation of PCT Application No. PCT/JP2014/074432, filed on Sep. 16, 2014, and claims the priority of Japanese Patent Application No. 2013-191340, filed on Sep. 17, 2013, the content of both of which is incorporated herein by reference.

BACKGROUND

Technical Field

The disclosure relates to a shield unit.

Related Art

A shield unit of Japanese Unexamined Patent Application Publication No. 2012-521068 includes: a shield member that is a shield shell including a cylinder into which an electric wire is inserted; a braid including a folded portion that is formed by folding an end of the braid and the folded portion is arranged in the cylinder; and a shield cover that is a rear holder inserted in the folded portion and attached to the cylinder of the shield member so as to electrically connect the shield member to the braid.

In the shield unit, an inner space is defined between the inner circumference portion of the outer insulating body of the housing to which the shield member is attached and the outer circumference portion of the shield member. The folded portion of the braid is located in the inner space. Inserting a pressing unit formed on the shield cover into the folded portion makes the shield member and the braid be electrically connected.

SUMMARY

The surface of the braid is sometimes covered with an oxidation coating in the shield unit according to Japanese Unexamined Patent Application Publication No. 2012-521068. The formed oxidation coating increases the contact resistance and blocks the electrical connection between the shield shell and the braid. The oxidation coating formed on the surface of the braid as described above is removed by sliding the surface of the braid under a degree of pressing force. This decreases the resistance.

However, the rear holder is merely attached to the cylinder of the shield shell in the shield unit according to Japanese Unexamined Patent Application Publication No. 2012-521068. The sliding distance traveled by the surface of the braid is limited to a distance in an attachment direction in which the rear holder is attached to the cylinder. This may make it impossible to secure the sliding distance long enough to decrease the resistance.

To secure the sufficient sliding distance traveled by the surface of the braid when the rear holder is attached to the cylinder, for example, it may be thought that increasing the sliding distance in the attachment direction in which the rear holder is attached to the cylinder. This increase also increases the length of the shield shell or housing in the attachment direction. This causes the shield unit to increase in size.

An object of the disclosure is to provide a shield unit in which the sufficient sliding distance traveled by the braid can be secured without increasing the shield unit in size.

A shield unit in accordance with some embodiments includes: a shield shell having a cylinder into which an electric wire is inserted; a braid having a contact portion arranged in contact with the cylinder; a holder inserted in the cylinder and attached to the cylinder in contact with the contact portion, the holder attached to the cylinder electrically connecting the shield shell to the braid; and a rotation unit provided between the cylinder and the holder, the rotation unit being configured to make the holder rotate in a circumferential direction of the cylinder and make the cylinder and the contact portion slide relatively to each other until completion of attaching the holder to the cylinder.

A rotation unit is provided in the configuration described above. The rotation unit is used to rotate the holder in a circumferential direction of the cylinder and make the cylinder and the contact portion of the braid slide along each other until the holder is attached to the cylinder of the shield shell. The rotation can secure the sliding distance traveled by the braid in the circumferential direction of the cylinder in addition to the attachment direction in which the holder is attached to the cylinder.

Thus, it is not necessary to increase the shield shell in size in the attachment direction in which the holder is attached to the shield shell in order to secure the sliding distance traveled by the braid when the holder is attached.

Thus, a sufficient sliding distance traveled by the braid can be secured in the shield unit having the configuration described above without increasing the shield unit in size because the rotation unit makes the holder rotate in the circumferential direction of the cylinder.

The rotation unit may include: a guide groove provided in one of the cylinder or the holder; and a protrusion provided on the other one of the cylinder or the holder and being engageable with the guide groove, the protrusion in movement along the guide groove upon the holder being attached to the cylinder making the holder rotate.

In the configuration described above, attaching the holder to the cylinder of the shield shell can easily rotate the holder and slide the braid.

The holder may include: an insertion portion inserted in the cylinder in contact with the contact portion; and an outer tube arranged at an outer circumference of the insertion portion and defining an attachment groove with the insertion portion in a radial direction of the outer tube and the insertion portion, the cylinder being inserted in the attachment groove. The rotation unit may include: a guide groove provided in the outer tube; and a protrusion provided on an outer circumference surface of the cylinder and being engageable with the guide groove, the protrusion in movement along the guide groove upon the holder being attached to the cylinder making the contact portion rotate in a circumferential direction of the cylinder and making the cylinder and the contact portion slide relatively to each other.

In the configuration described above, the guide groove is placed at a place at which the groove is visibly confirmed. Thus, when the holder is attached to the cylinder, it can visually be confirmed how the protrusion is inserted and guided in the guide groove. This visual confirmation can make the attachment process more accurate and efficient. When the holder is attached to the cylinder and, for example, the braid is attached closely to the holder, the braid can be prevented from entering the guide groove. This makes it possible to avoid the problem that the entrance of the braid to the guide groove hinders the entrance of the protrusion to the guide groove and thus hinders the attachment of the holder to the cylinder, or the problem that insufficient insertion of the holder to the cylinder causes insufficient attachment of the holder to the cylinder.

A gap may exist between an end of the cylinder and a bottom of the attachment groove in the attachment groove upon the completion of attaching the holder to the cylinder.

In the configuration described above, when a part (for example, an end) of the contact portion of the braid is exposed from the end of the cylinder toward the holder, the part of the contact portion is accommodated in the gap. This accommodation can prevent the end of the cylinder and the bottom of the attachment groove from holding the part of the contact portion of the braid therebetween. This makes it possible to avoid insufficient attachment of the holder to the cylinder caused by the hold of the part of the contact portion.

The contact portion may include a folded portion formed by folding an end of the braid, and the holder may be inserted in the folded portion and attached to the cylinder.

In the configuration described above, the holder can be inserted in the folded portion of the braid and attached to the cylinder. The holder can easily hold the braid when the holder is attached to the cylinder.

The cylinder may include an inclined portion inclined such that a contact pressure between the cylinder and the folded portion exerted by the holder gradually increases toward a rear side of the cylinder in an attachment direction in which the holder is attached to the cylinder.

In the configuration described above, the contact pressure between the shield shell and the braid can be maximized when the holder is attached to the cylinder. This can improve the reliability of electrical connection between the shield shell and the braid.

The cylinder may include an accommodating portion for accommodating the contact portion between the cylinder and the holder.

In the configuration described above, the contact between the shield shell and the braid can be secured without providing the folded portion on the braid. When the folded portion is provided on the braid, the shield shell is placed between the inner and outer circumference surfaces of the folded portion of the braid holding the holder therebetween. This can increase the contact area between the shield shell and the braid. This can further improve the reliability of electrical connection between the shield shell and the braid.

The shield unit may further include a handle formed on the holder for attachment.

The configuration described above enables an operator to easily insert the braid in the shield shell while applying a load by grasping the handle, and thus can, or to easily rotate and fix the holder in order to attach the holder to the cylinder.

The configuration can implement a shield unit in which a sufficient sliding distance traveled by the braid can be secured without increasing the shield unit in size.

BRIEF DESCRIPTION OF DRAWINGS

FIG. 7A is an exploded perspective view of a shield unit according to a second embodiment of the present invention.

FIG. 7B is an enlarged view of the main components of FIG. 7A.

DETAILED DESCRIPTION

Figure 1A:
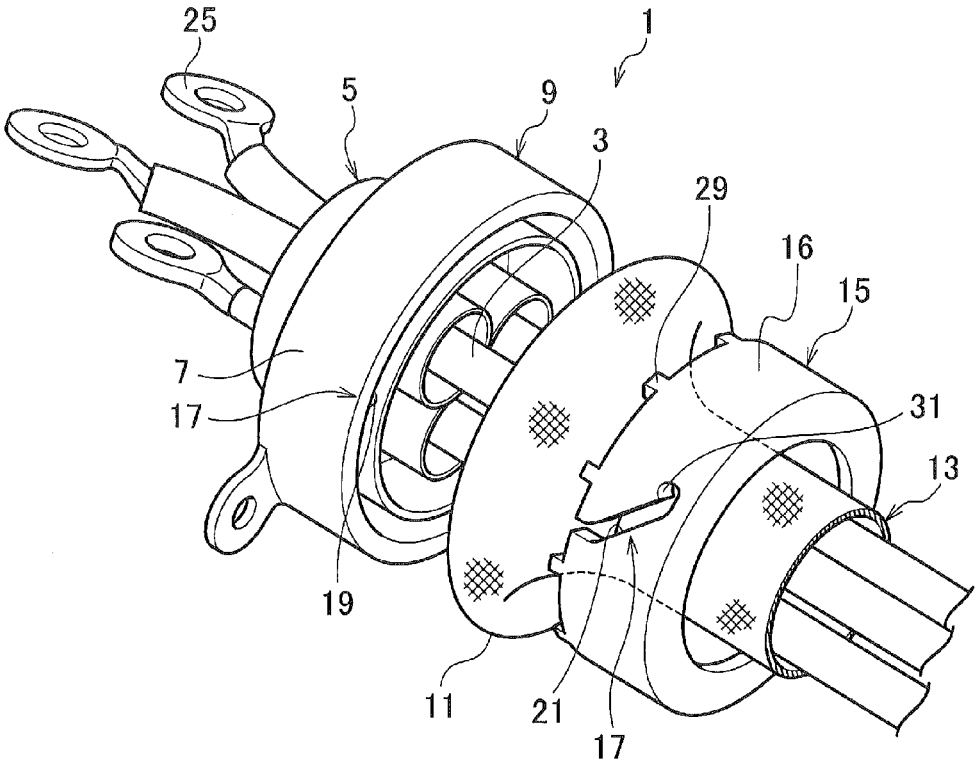
FIG. 1A is an exploded perspective view of a shield unit according to a first embodiment of the present invention.
Figure 1B:
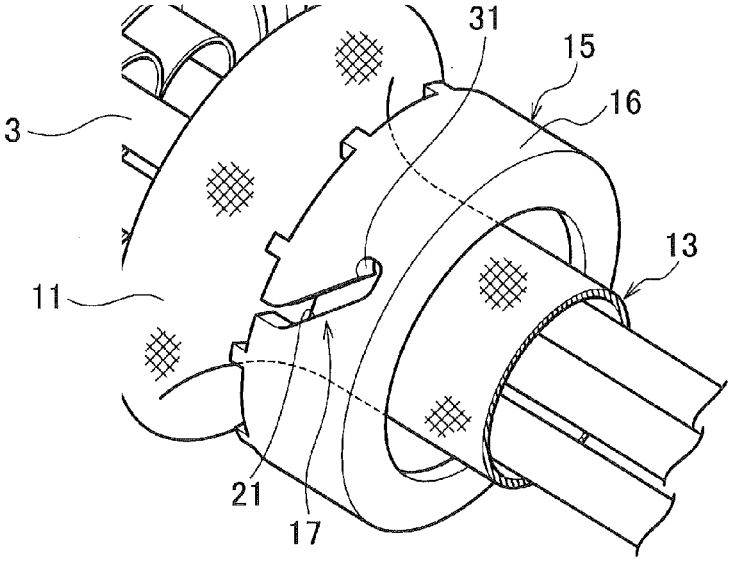
FIG. 1B is an enlarged view of the main components of FIG. 1A.
Figure 2A:
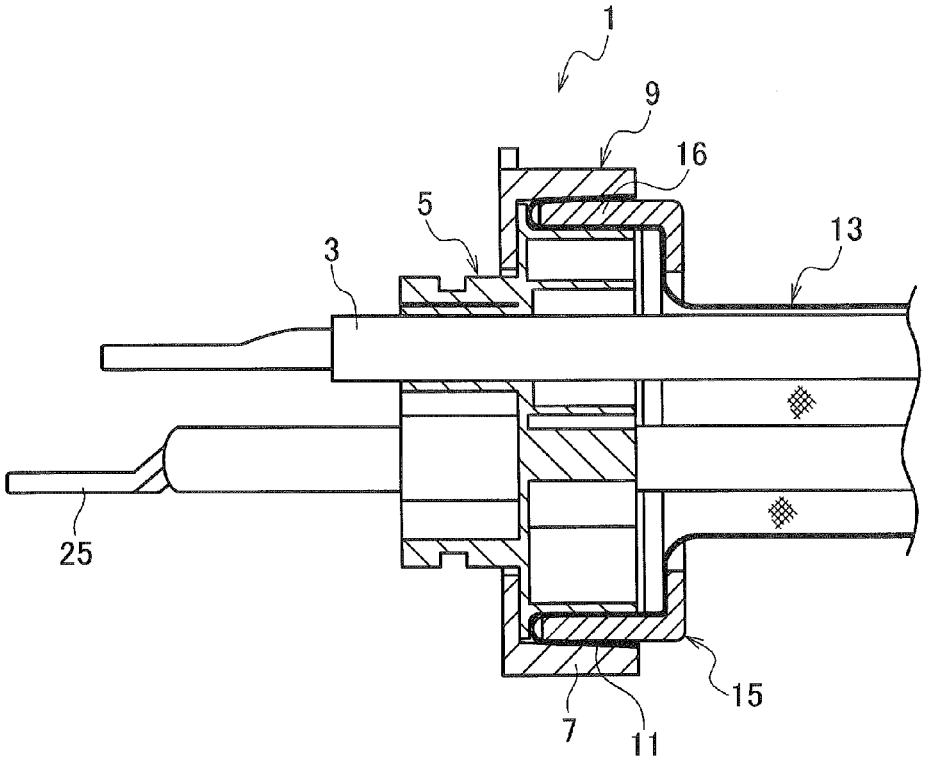
FIG. 2A is a cross-sectional view of the shield unit according to the first embodiment.
Figure 2B:
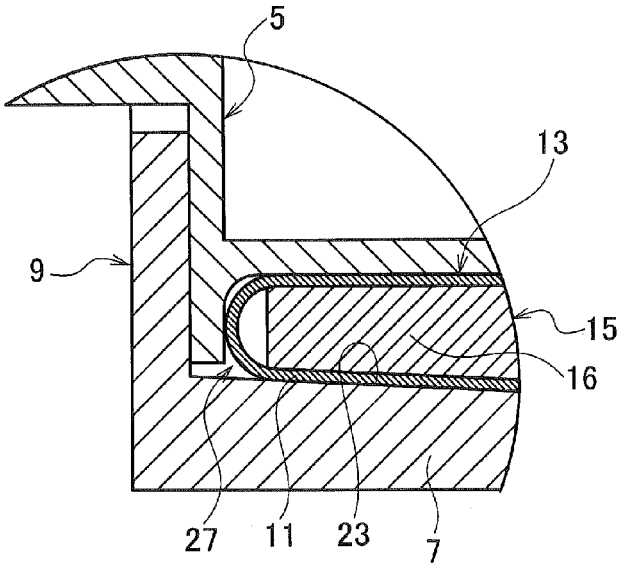
FIG. 2B is an enlarged view of the main components of FIG. 2A.

A shield unit 1 according to a first embodiment of the present invention will be described with reference to FIGS. 1A to 6B.

The shield unit 1 according to the first embodiment includes: a housing 5 into which an electric wire 3 is inserted; a shield shell 9 including a cylinder 7 arranged on the outer circumstance of the housing 5; a braid 13 including a folded portion 11 that is formed by folding an end of the braid 13 and arranged in the cylinder 7 and the folded portion 11 is a contact portion having contact with the cylinder 7; and a rear holder 15 that is a holder inserted in the folded portion 11 and attached to the cylinder 7 of the shield shell 9 so as to electrically connect the shield shell 9 to the braid 13.

A rotation unit 17 is provided between the cylinder 7 of the shield shell 9 and the rear holder 15. The rotation unit 17 is used to rotate the rear holder 15 in a circumferential direction of the cylinder 7 and make the cylinder 7 and the folded portion 11 of the braid 13 relatively slide until the rear holder 15 is attached to the cylinder 7 of the shield shell 9.

The rotation unit 17 includes a protrusion 19 provided on an inner circumference surface of the cylinder 7 in the shield shell 9, and a guide groove 21, which is provided in the rear holder 15 and which the protrusion 19 can be engaged with. The protrusion 19 moves along the guide groove 21 when the rear holder 15 is attached to the cylinder 7 of the shield shell 9 so that the rear holder 15 rotates in the circumferential direction of the cylinder 7.

An inclined portion 23 is provided in the cylinder 7 of the shield shell 9. The inclined portion 23 is inclined so that the rear holder 15 (the insertion portion 16 described below) increases the contact pressure between the folded portion 11 of the braid 13 and the cylinder 7 toward the rear side of the shield shell 9 in an attachment direction in which the rear holder 15 is attached to the shield shell 9 (the left side of the shield shell 9 in FIGS. 2A and 2B).

The housing 5 is made of an insulating material, and is formed into a cylindrical shape as illustrated in FIGS. 1A to 2B. The housing 5 is attached to a case (not illustrated) that houses a device or power source to which a terminal 25 is connected, or in a housing body (not illustrated) that houses the terminal 25.

The electric wire 3 is inserted in the housing 5. The terminal 25 is connected to the end of the electric wire 3. Covering the outer circumference of the electric wire 3 with the braid 13 can prevent, for example, noise from entering or leaking. The shield shell 9 is arranged on the outer circumference of the housing 5.

The shield shell 9 is made of a conductive material, and attached to the outer circumference of the housing 5. The shield shell 9 is provided with the cylinder 7 arranged apart from the outer circumference of the housing 5. In the cylinder 7 and the housing 5 attached to each other, the accommodating portion 27 is formed between the inner circumference surface of the cylinder 7 and the outer circumference surface of the housing 5 in a radial direction. The folded portion 11 of the braid 13 that is a contact portion having contact with the cylinder 7 is arranged in the accommodating portion 27.

The braid 13 is formed by a plurality of woven conductors made of a conductive material. The braid 13 is formed into a tubal shape. The braid 13 includes the folded portion 11 formed by folding the end of the braid 13 to be accommodated in the accommodating portion 27 toward the outer circumference. The folded portion 11 of the braid 13 is accommodated in the accommodating portion 27 so as to cover the outer circumference of the electric wire 3 led out of the housing 5.

The braid 13 is electrically connected to the shield shell 9 so as to form a shield circuit that prevent, for example, noise from entering or leaking from the electric wire 3. The rear holder 15 inserted in the accommodating portion 27 makes the braid 13 protecting the electric wire 3 as described above have contact with the inner circumference surface of the cylinder 7 in the shield shell 9 so that the braid 13 is electrically connected to the shield shell 9.

The rear holder 15 is made of an insulating material, and includes an insertion portion 16. The insertion portion 16 is formed into a cylindrical shape so as to be inserted in the accommodating portion 27. A plurality of fixing portions 29 protrudes from the end surface of the insertion portion 16 of the rear holder 15 in a circumferential direction. When the fixing portions 29 are inserted in the folded portion 11 of the braid 13, the fixing portions 29 enable the braid 13 to rotate integrally with the rear holder 15.

The insertion portion 16 of the rear holder 15 is inserted in the folded portion 11 while the folded portion 11 of the braid 13 is arranged in the accommodating portion 27. This makes the outer circumference surface of the braid 13 and the inner circumference surface of the cylinder 7 of the shield shell 9 attached closely to each other. The attachment of the rear holder 15 electrically connects the shield shell 9 to the braid 13 and forms a shield circuit.

The shield circuit is formed inside the inner circumference of the cylinder 7 of the shield shell 9. This formation improves the shielding performance from noise in comparison to the formation in which the shield circuit is formed outside the outer circumference of the cylinder 7.

In the embodiment, the inclined portion 23 is provided on the inner circumference surface of the cylinder 7 in the shield shell 9 so that the inner diameter decreases toward the rear side in the attachment direction in which the rear holder 15 is attached (the side facing the terminal 25 in a length direction of the electric wire 3).

The inclined portion 23 increases the contact pressure between the cylinder 7 of the shield shell 9 and the folded portion 11 of the braid 13 as the process for attaching the rear holder 15 to the shield shell 9 comes to the end while the rear holder 15 is inserted in the accommodating portion 27.

Accordingly, when the rear holder 15 is completely attached to the shield shell 9, the contact pressure between the cylinder 7 of the shield shell 9 and the folded portion 11 of the braid 13 is maximized. This can improve the reliability of electrical connection between the shield shell 9 and the braid 13.

When the braid 13 of the shield unit 1 is made of a material such as aluminum, the surface of the braid 13 is covered with an oxidation coating. This increases the contact resistance in comparison with a case in which a material such as copper is used as the material of the braid 13. Additionally, when the shield shell 9 is also made of a material such as aluminum, or a zinc coated material that is easily covered with an oxidation coating, this makes it more difficult to electrically connect the shield shell 9 to the braid 13.

When such a material that that is easily covered with an oxidation coating is used, it is confirmed that making the surfaces of the shield shell 9 and the braid 13 slide along each other under a degree of pressing force removes the oxidation coatings. This decreases the resistance.

Thus, in a conventional shield unit, attaching the rear holder to the cylinder of the shield shell (the accommodating portion) makes the surfaces of the shield shell and the braid slide along each other. This sliding removes the oxidation coatings formed on the surfaces.

However, in the configuration in which the rear holder is merely attached to the cylinder of the shield shell, the sliding distance traveled by the surfaces of the shield shell and the braid is limited to the distance in the attachment direction in which the rear holder is attached to the cylinder (the length direction of the electric wire). It may be impossible to secure the sliding distance long enough to reduce the resistance.

If the housing forming the accommodating portion and the cylinder of the shield shell is increased in size in the attachment direction in order to secure the sliding distance, the shield unit increases in size. In light of the foregoing, the rotation unit 17 is provided in the shield unit 1 in the present embodiment.

The rotation unit 17 is provided between the cylinder 7 of the shield shell 9 and the insertion portion 16 of the rear holder 15. The rotation unit 17 includes the protrusion 19 provided on the inner circumference surface of the cylinder 7 of the shield shell 9, and the guide groove 21 provided in the insertion portion 16 of the rear holder 15.

Two protrusions 19 are provided on the inner circumference surface of the cylinder 7 of the shield shell 9 at the same intervals in the circumferential direction, and protrude from the inner circumference surface of the cylinder 7 toward the inside of the accommodating portion 27. The protrusion 19 is inserted in the guide groove 21 when the rear holder 15 is inserted in the accommodating portion 27.

Two guide grooves 21 are provided on the peripheral wall of the insertion portion 16 of the rear holder 15 at the same intervals in the circumferential direction and are formed into a symmetrical shape inclined in the attachment direction in which the rear holder 15 is attached. Each of the guide grooves 21 is provided with an opening end for the protrusions 19. The bottom of the guide groove 21 is formed into a concave shape, and is provided with the seizing portion 31. The seizing portion 31 is engaged with the protrusion 19 and supports the rear holder 15 while the rear holder 15 is completely attached to the inside of the accommodating portion 27.

The protrusion 19 is inserted from the opening of the guide groove 21 when the rear holder 15 is attached. The insertion portion 16 of the rear holder 15 is inserted in the accommodating portion 27 while the protrusion 19 is inserted in the guide groove 21. This insertion moves the protrusion 19 along the guide groove 21. The movement of the protrusion 19 in the guide groove 21 rotates the rear holder 15 in the circumferential direction of the cylinder 7 until the insertion portion 16 of the rear holder 15 is attached to the cylinder 7 (the accommodating portion 27) of the shield shell 9, in more detail, until the protrusion 19 is engaged with the seizing portion 31 of the guide groove 21.

At that time, the braid 13 moves in response to the operation of the rear holder 15. Thus, the braid 13 moves in the attachment direction in which the rear holder 15 is attached (the length direction of the electric wire 3) while rotating in the circumferential direction of the cylinder 7 in the shield shell 9, and slides along the inner circumference surface of the cylinder 7. This sliding can remove the oxidation coatings formed on the surfaces of the shield shell 9 and the braid 13.

Rotating the rear holder 15 with the rotation unit 17 as described above can secure the sliding distance traveled by the braid 13 in the circumferential direction of the cylinder 7 in addition to the attachment direction in which the rear holder 15 is attached. Thus, it is not necessary to increase the housing 5 or the shield shell 9 in size in the attachment direction in which the rear holder 15 is attached in order to secure a sufficient sliding distance traveled by the braid 13 when the rear holder 15 is attached.

Figure 3:
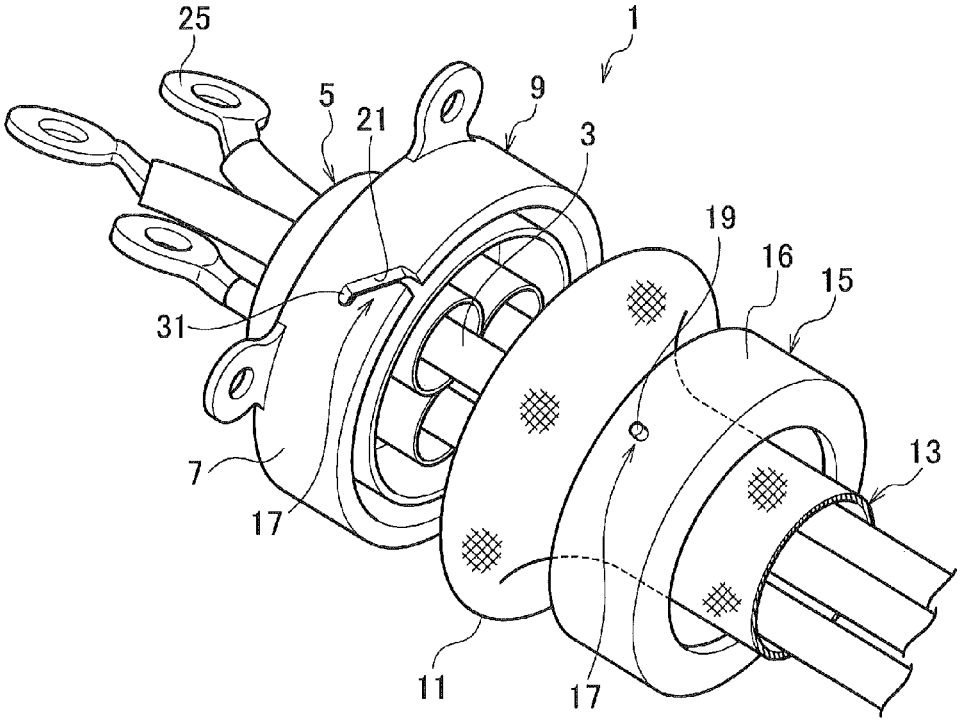
FIG. 3 is an exploded perspective view of an exemplary variation of a rotation unit of the shield unit according to the first embodiment.

As illustrated in FIG. 3, the rotation unit 17 can be formed by the protrusion 19 provided on the insertion portion 16 of the rear holder 15 and the guide groove 21 provided on the cylinder 7 of the shield shell 9. In such a formation, the guide groove 21 is located at a place at which the guide groove 21 is visually confirmed. Thus, when the rear holder 15 is attached to the shield shell 9, it can visually be confirmed how the protrusion 19 is inserted and guided in the guide groove 21. This can make the attachment process more accurate and efficient.

Figure 4:
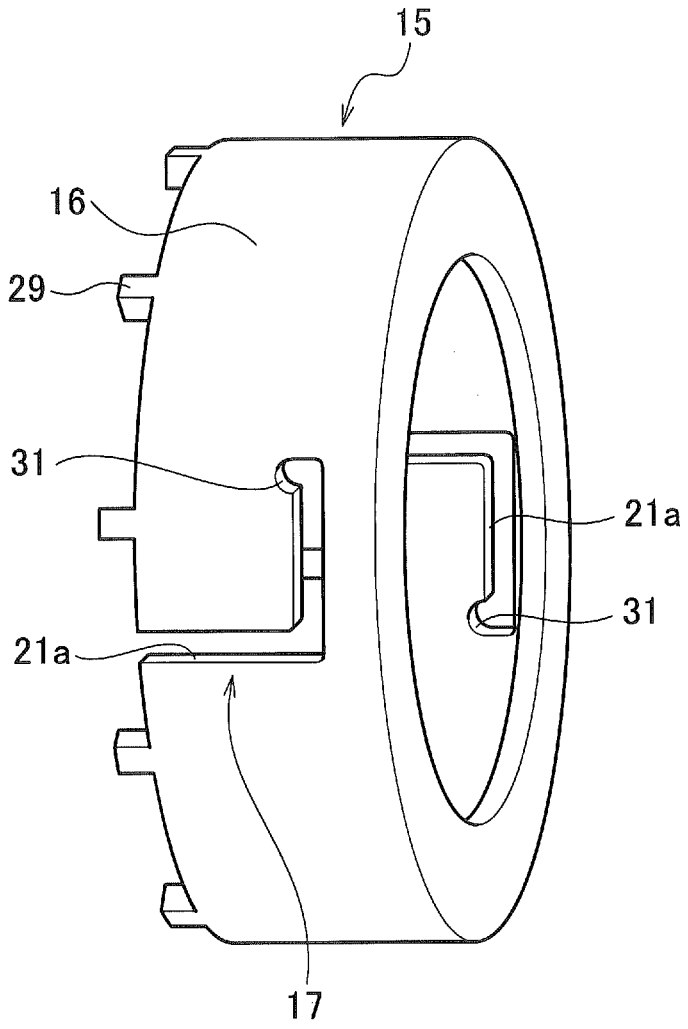
FIG. 4 is a perspective view of an exemplary variation of a guide groove of the shield unit according to the first embodiment.

As illustrated in FIG. 4, a guide groove 21*a* of the rotation unit 17 can be formed into an L shape on the peripheral wall of the insertion portion 16 of the rear holder 15. The protrusion 19 is inserted from an opening of the guide groove 21*a* when the rear holder 15 is attached. When the insertion portion 16 of the rear holder 15 is completely inserted in the accommodating portion 27, the protrusion 19 is placed at the bent portion of the L shape. From the position, the rear holder 15 is rotated along the cylinder 7 of the shield shell 9. This rotation moves the protrusion 19 along the guide groove 21*a* and engages the protrusion 19 with the seizing portion 31.

Forming the guide groove 21*a* as described above increases the travel distance traveled by the rear holder 15 in the circumferential direction of the cylinder 7 in the shield shell 9, and thus can increase the sliding distance traveled by the braid 13 and the shield shell 9 in the circumferential direction.

Figure 5A:
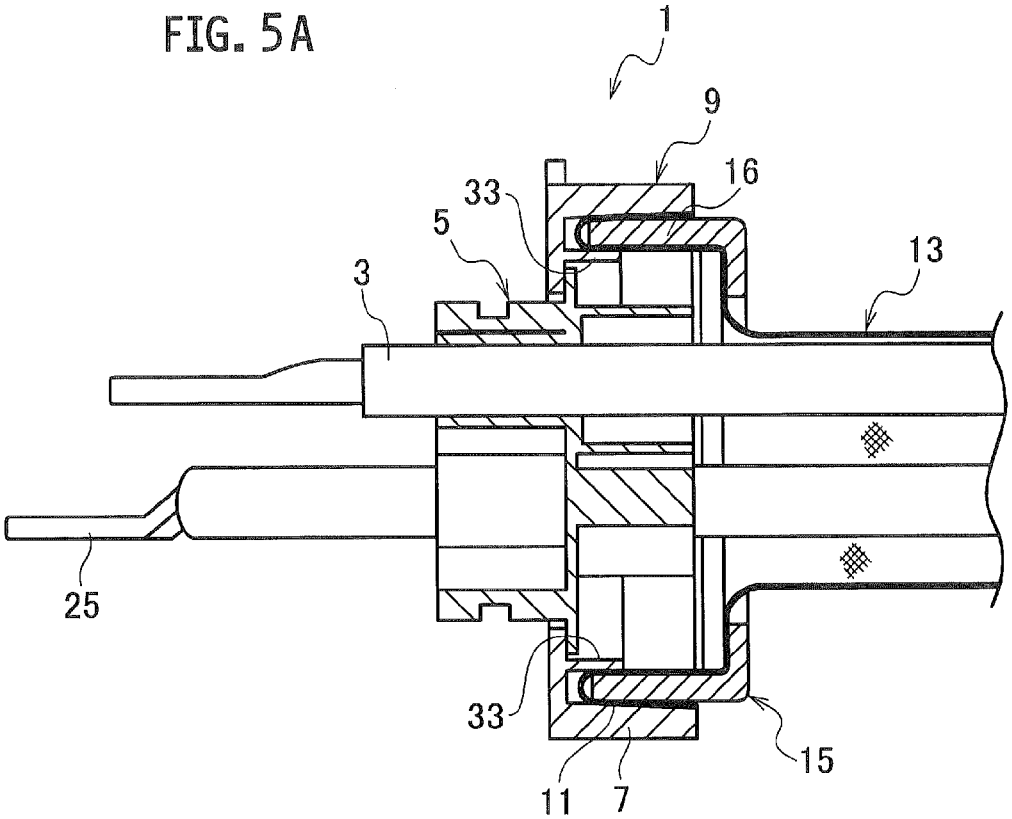
FIG. 5A is a cross-sectional view of an exemplary variation of an accommodating portion of the shield unit according to the first embodiment.
Figure 5B:
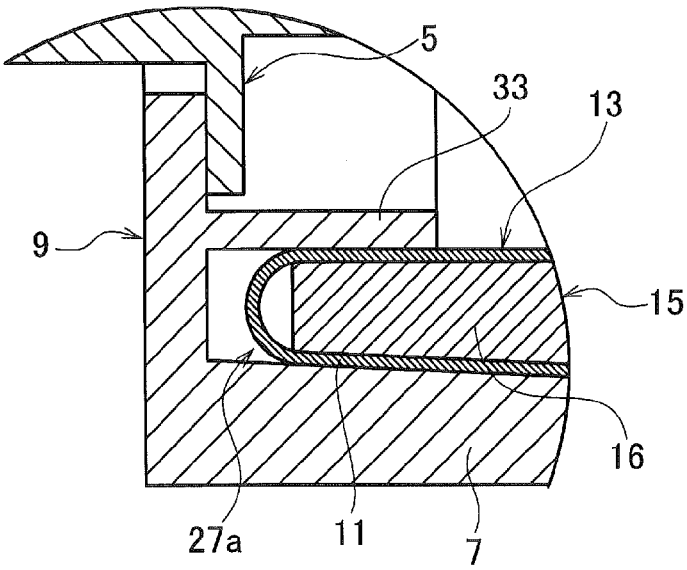
FIG. 5B is an enlarged view of the main components of FIG. 5A.

The example in which the accommodating portion 27 for accommodating the insertion portion 16 of the rear holder 15 is provided between the outer circumference surface of the housing 5 and the inner circumference surface of the cylinder 7 of the shield shell 9 is described. However, the present invention is not limited to the example. For example, as illustrated in FIG. 5B, a cylinder 33 corresponding to the outer circumference surface of the housing 5 can be formed inside the cylinder 7 of the shield shell 9. In such a formation, an accommodating portion 27*a* can be formed between the inner circumference surface of the cylinder 7 of the shield shell 9 and the outer circumference surface of the cylinder 33 in a radial direction.

Providing the accommodating portion 27*a* in the shield shell 9 makes the shield shell 9 have contact with both of the front surface and rear surface of the folded portion 11 of the braid 13 that holds the insertion portion 16 of the rear holder 15. The front surface is a surface of the braid 13 facing the outer circumference surface of the cylinder 33. The rear surface is a surface of the braid 13 facing the inner circumference surface of the cylinder 7. This can increase the contact area between the shield shell 9 and the braid 13. This can further improve the reliability of electrical connection between the shield shell 9 and the braid 13.

Note that the inclined portion 23, which is inclined so that the attachment of the rear holder 15 increase the contact pressure between the shield shell 9 and the folded portion 11 of the braid 13, can be provided also in the accommodating portion 27*a*, similarly to the accommodating portion 27.

The rotation unit 17, which is used to rotate the rear holder 15 along the circumferential direction of the cylinder 7 and make the cylinder 7 and the folded portion 11 of the braid 13 slide along each other until the rear holder 15 is attached to the cylinder 7 of the shield shell 9, is provided also in the shield unit 1 described with reference to FIGS. 5A and 5B. This can secure the sliding distance traveled by the braid 13 in the circumferential direction of the cylinder 7 in addition to in the attachment direction in which the rear holder 15 is attached.

Thus, it is not necessary to increase the housing 5 or the shield shell 9 in size in the attachment direction in which the rear holder 15 is attached in order to secure the sliding distance traveled by the braid 13 when the rear holder 15 is attached.

Thus, the rotation unit 17 makes the rear holder 15 rotate along the circumferential direction of the cylinder 7 in the shield unit 1. This can secure a sufficient sliding distance traveled by the braid 13 without increasing the shield unit 1 in size.

Furthermore, the rotation unit 17 includes the protrusion 19 and the guide groove 21. Attaching the rear holder 15 to the cylinder 7 of the shield shell 9 moves the protrusion 19 along the guide groove 21. This movement rotates the rear holder 15. This can easily rotate the rear holder 15 and slide the braid 13 along the shield shell 9 when the rear holder 15 is attached to the cylinder 7 of the shield shell 9.

The inclined portion 23, which is inclined so that the contact pressure between the shield shell 9 and the folded portion 11 of the braid 13 exerted by the rear holder 15 increases toward the rear side in the attachment direction in which the rear holder 15 is attached, is provided in the cylinder 7 of the shield shell 9. This can maximize the contact pressure between the shield shell 9 and the braid 13 when the rear holder is attached, and thus can improve the reliability of electrical connection between the shield shell 9 and the braid 13.

Figure 6A:
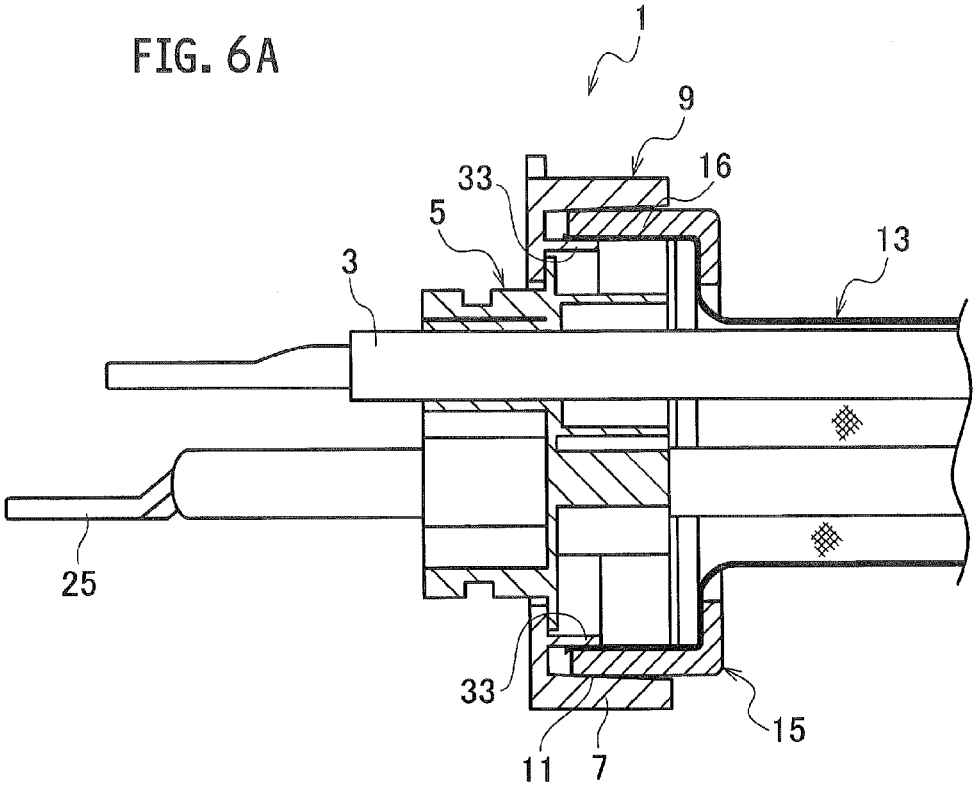
FIG. 6A is a cross-sectional view of another exemplary variation of the accommodating portion of the shield unit according to the first embodiment.
Figure 6B:
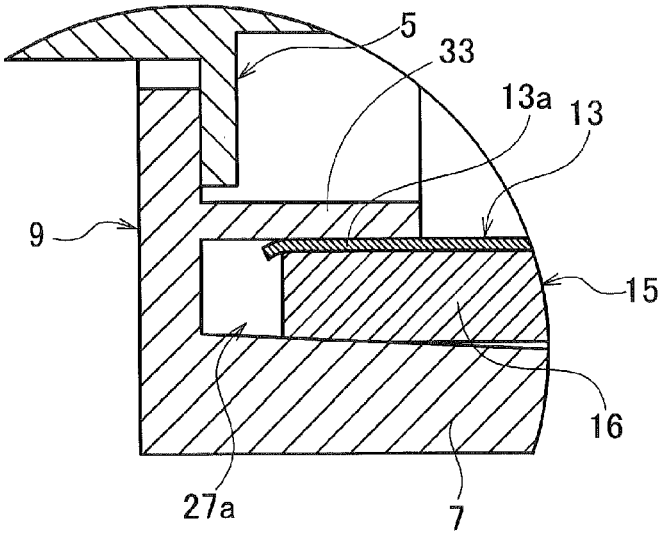
FIG. 6B is an enlarged view of the main components of FIG. 6A.
Figure 8A:
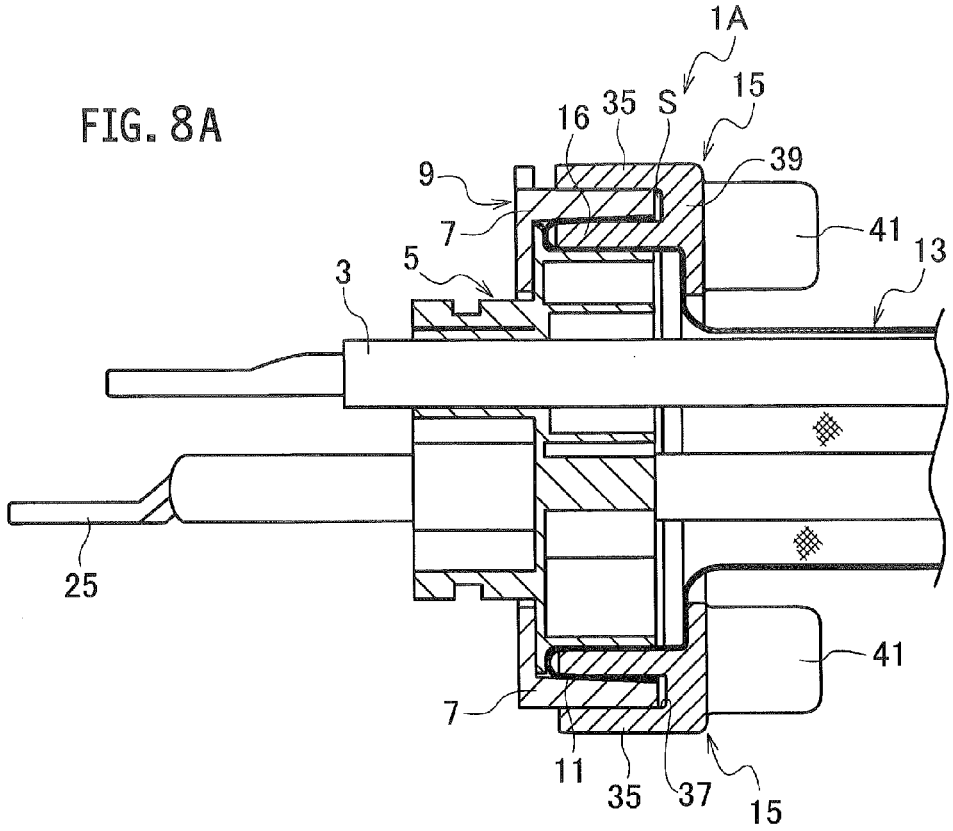
FIG. 8A is a cross-sectional view of the shield unit according to the second embodiment.
Figure 8B:
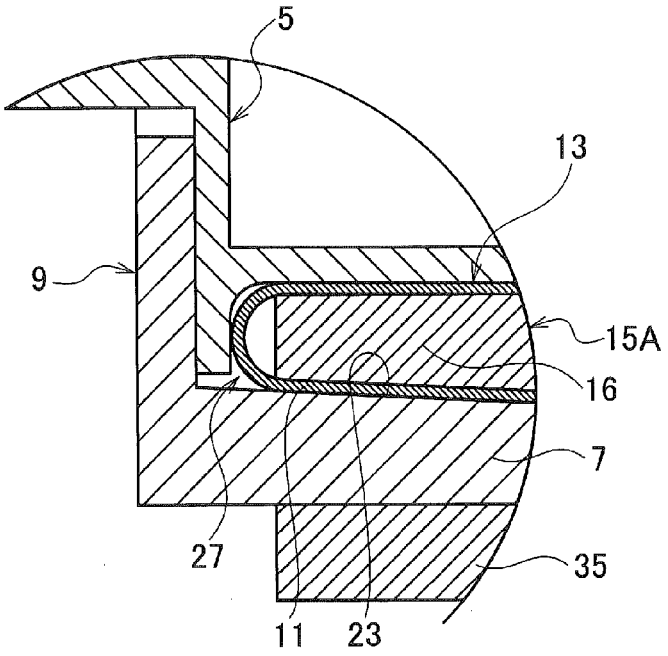
FIG. 8B is an enlarged view of the main components of FIG. 8A.

Note that the braid 13 does not have to necessarily include the folded portion 11 in the shield unit 1 described with reference to FIGS. 5A and 5B. In other words, it is not necessary to fold the end of the braid 13. In such a case, a portion 13*a* is the contact portion of the braid 13 having contact with the cylinder 7 as illustrated in FIGS. 6A and 6B. The portion 13*a* is the surface of the end of the braid 13. The surface faces the outer circumference surface of the cylinder 33 and is held by the insertion portion 16 and the cylinder 33.

As described with reference to FIGS. 1A to 5B, the engagement of the protrusion 19 with the seizing portion 31 formed in the guide groove 21 seizes the rear holder 15 in the shield unit 1 according to the embodiment of the present invention. Note that, however, the present invention is not limited to the embodiment. For example, a seizing portion other than the protrusion 19 and the guide groove 21 of the housing 5 or the shield shell 9 can seize the rear holder 15.

The shield shell 9 is attached to the outer circumference surface of the housing 5. However, the position to which the shield shell 9 is attached is not limited to the outer circumference surface of the housing 5. For example, the shield shell 9 can be attached to the wall of the casing from which the electric wire 3 is extracted. The shield shell 9 can be arranged at any place in the housing 5 as long as the electric wire 3 is inserted in the shield shell 9.

The protruding fixing portions 29 provided on the rear holder 15 fixes the rear holder 15 to the braid 13 so that the rear holder 15 and the braid 13 are integrally rotatable. However, the present invention is not limited to the embodiment. For example, any configuration that makes the rear holder 15 move in response to the operation of the braid 13, for example, the friction between the rear holder 15 and the braid 13 can be used.

The folded portion 11 of the braid 13 is arranged on the side of the shield shell 9 facing the inner circumference surface of the cylinder 7. However, the arrangement is not limited to the embodiment. For example, the folded portion 11 of the braid 13 can be arranged on a side of the shield shell 9 facing the outer circumference surface of the cylinder 7. In such an arrangement, the protrusion 19 of the rotation unit 17 needs protruding in the opposite direction to the embodiment.

In the shield unit 1, the guide groove 21 of the rotation unit 17 is provided in the insertion portion 16 of the rear holder 15 or in the cylinder 7 of the shield shell 9, and the protrusion 19 of the rotation unit 17 is provided on the cylinder 7 of the shield shell 9 or on the insertion portion 16 of the rear holder 15. However, the positions of the guide groove 21 and the protrusion 19 are not limited to the embodiment. For example, the protrusion 19 of the rotation unit 17 can be provided on the housing 5. In such a case, attaching the rear holder 15 can rotate the rear holder 15.

Accordingly, the effects similar to the shield unit 1 according to the first embodiment can be provided in the configuration described above. The similar configuration is also included in the present invention.

A shield unit 1A according to a second embodiment of the present invention will be described next with reference to FIGS. 7A to 8B.

Differently from the shield unit 1 according to the first embodiment in FIGS. 1A to 2B, in the shield unit 1A according to the second embodiment, a rear holder 15A working as a holder includes an outer tube 35 formed outside the outer circumference of an insertion portion 16, a guide groove 21 of a rotation unit 17 is provided not on the insertion portion 16 but on the outer tube 35 in of the rear holder 15, a protrusion 19 of the rotation unit 17 is provided not on the inner circumference surface but on the outer circumference surface of a cylinder 7 in the shield shell 9, and the rear holder 15A includes handles 41. The other components or functions are similar to those of the shield unit 1 according to the first embodiment and thus the descriptions will properly be omitted.

As illustrated in FIGS. 7A to 8B, the rear holder 15A includes the outer tube 35 formed outside the outer circumference of the insertion portion 16. The outer tube 35 has a shape similar to the insertion portion 16 and coaxially enlarged in a radial direction. The outer tube 35 is formed integrally with the insertion portion 16 through an upper surface 39. An attachment groove 37 is formed between the outer circumference surface of the insertion portion 16 and the inner circumference surface of the outer tube 35 in a radial direction. The cylinder 7 of the shield shell 9 is inserted in the attachment groove 37 when the rear holder 15A is attached in the accommodating portion 27. The attachment groove 37 is formed into a shape that can hold the cylinder 7 of the shield shell 9 when the cylinder 7 is inserted therein. When the rear holder 15A (the insertion portion 16) is completely attached in the accommodating portion 27, a gap (space) S exists between the end of the attachment groove 37 (the back surface of the upper surface 39) and the end of the cylinder 7 in the attachment groove 37. Note that it is not necessary to provide the gap S.

The rear holder 15A includes the two handles (tabs) 41 formed on the upper side and lower side of the upper surface 39 across the central axis of the rear holder 15A. An operator can rotate the rear holder 15A by grasping the handle 41 and applying a load on the rear holder 15A. Note that the number of the handles 41 is not limited to two, and the positions of the handles 41 are also not limited to the upper side and lower side of the upper surface 39. The number and positions of the handles 41 can arbitrarily be set. Alternatively, it is not necessary to provide the handle 41.

The rotation unit 17 is provided between the cylinder 7 of the shield shell 9 and the outer tube 35 of the rear holder 15A. The rotation unit 17 includes the protrusion 19 provided on the outer circumference surface of the cylinder 7 of the shield shell 9, and the guide groove 21 provided in the outer tube 35 of the rear holder 15A.

Two protrusions 19 are provided on the outer circumference surface of the cylinder 7 of the shield shell 9 at the same intervals in a circumferential direction. The two protrusions 19 protrude from the outer circumference surface of the cylinder 7 outward (in a direction opposite to the side of the cylinder 7 facing the accommodating portion 27). The protrusion 19 is inserted in the guide groove 21 when the rear holder 15A is inserted in the accommodating portion 27.

Two guide grooves 21 are provided on the peripheral wall of the outer tube 35 of the rear holder 15A at the same intervals in a circumferential direction, and are formed into a symmetrical shape inclined in an attachment direction in which the rear holder 15A is attached. Each of the guide grooves 21 is provided with an opening end for each of the protrusions 19. The bottom of the guide groove 21 is formed into a concave shape, and is provided with the seizing portion 31 that is engaged with the protrusion 19 and supports the rear holder 15A while the rear holder 15A is completely attached to the inside of the accommodating portion 27.

The protrusion 19 is inserted in the opening of the guide groove 21 when the rear holder 15A is attached. The cylinder 7 of the shield shell 9 is inserted in the attachment groove 37 of the rear holder 15A while the protrusion 19 is inserted in the guide groove 21. This insertion moves the protrusion 19 along the guide groove 21. The movement of the protrusion 19 in the guide groove 21 rotates the rear holder 15A in the circumferential direction of the cylinder 7 until the outer tube 35 of the rear holder 15A is attached to the cylinder 7 of the shield shell 9, in more detail, until the protrusion 19 is engaged with the seizing portion 31 of the guide groove 21.

At that time, the braid 13 moves in response to the operation of the rear holder 15A. Thus, the braid 13 moves in the attachment direction in which the rear holder 15A is attached (the length direction of the electric wire 3) while rotating in the circumferential direction of the cylinder 7 of the shield shell 9, and slides along the inner circumference surface of the cylinder 7. This sliding can remove the oxidation coatings formed on the surfaces of the shield shell 9 and the braid 13.

Rotating the rear holder 15A with the rotation unit 17 as described above can secure the sliding distance traveled by the braid 13 in the circumferential direction of the cylinder 7 in addition to the attachment direction in which the rear holder 15A is attached. Thus, it is not necessary to increase the housing 5 or the shield shell 9 in size in the attachment direction in which the rear holder 15A is attached in order to secure a sufficient sliding distance traveled by the braid 13 when the rear holder 15A is attached.

In the shield unit 1A according to the second embodiment, the guide grooves 21 of the rotation unit 17 are provided on the outer tube 35 of the rear holder 15A, and the protrusions of the rotation unit 17 are provided on the outer circumference surface of the cylinder 7 of the shield shell 9. In such an arrangement, the guide groove 21 is located at a place at which the guide groove 21 is visually confirmed. Thus, when the rear holder 15A is attached to the shield shell 9, it can visually be confirmed how the protrusion 19 is inserted and guided in the guide groove 21. This can make the attachment process more accurate and efficient.

In the shield unit 1A according to the second embodiment, the guide grooves 21 of the rotation unit 17 are provided not on the insertion portion 16 of the rear holder 15A that have contact with the braid 13 but on the outer tube 35 of the rear holder 15A that does not have contact with the braid 13. Thus, when the rear holder 15A is attached to the shield shell 9 and, for example, the braid 13 is attached closely to the rear holder 15A, the braid 13 can be prevented from entering the guide groove 21. This makes it possible to avoid, for example, the problem that the entrance of the braid 13 to the guide groove 21 hinders the entrance of the protrusion 19 to the guide groove 21 and thus hinders the attachment of the rear holder 15A to the shield shell 9, or the problem that insufficient insertion of the rear holder 15A to the shield shell 9 causes insufficient attachment of the rear holder 15A to the shield shell 9.

In the shield unit 1A according to the second embodiment, the handles 41 are provided on the upper surface 39 of the rear holder 15A. Thus, the operator can grasp the handles 41, and can easily insert the braid 13 in the shield shell 9 while applying a load on the handles 41 or can easily rotate and fix the rear holder 15A to attach the rear holder 15A to the shield shell 9.

In the shield unit 1A according to the second embodiment, a gap S exist between the end of the cylinder 7 and the bottom (the portion facing the end of the cylinder 7) of the attachment groove 37 in the attachment groove 37 when the rear holder 15A (the insertion portion 16) is completely attached in the inside of the accommodating portion 27. Thus, when a part of the folded portion 11 of the braid 13 is exposed from the end of the cylinder 7 toward the rear holder 15A, the part of the folded portion 11 is accommodated in the gap S. This accommodation can prevent the end of the cylinder 7 and the bottom of the attachment groove 37 from holding the part of the folded portion 11 of the braid 13 therebetween. This makes it possible to avoid insufficient attachment of the rear holder 15A to the shield shell 9 caused by the hold of the part of the folded portion 11.

The exemplary variations described with reference to FIGS. 4 to 6B can be applied also to the shield unit 1A according to the second embodiment.

In this way, the present invention includes various embodiments not described above. Therefore, the scope of the present invention is determined only by the invention identification matters according to claims reasonable from the foregoing description.

What is claimed is:

1. A shield unit comprising:

a shield shell having a cylinder into which an electric wire is inserted;

a braid having a first contact portion arranged in contact with a second contact portion of the cylinder;

a holder inserted in the cylinder and attached to the cylinder in contact with the first contact portion, the holder attached to the cylinder electrically connecting the shield shell to the braid; and a rotation unit provided between the cylinder and the holder, the rotation unit being configured to make the holder rotate in a circumferential direction of the cylinder and make the second contact portion and the first contact portion slide relatively to each other in the circumferential direction until completion of attaching the holder to the cylinder.

2. The shield unit according to claim 1, wherein the rotation unit comprises:

a guide groove provided in one of the cylinder or the holder; and a protrusion provided on the other one of the cylinder or the holder and being engageable with the guide groove, the protrusion in movement along the guide groove upon the holder being attached to the cylinder making the holder rotate.

3. The shield unit according to claim 1, wherein the holder and the cylinder hold the braid between the cylinder and the holder.

4. The shield unit according to claim 1, wherein the rotation unit comprises:

a guide groove provided in the holder; and a protrusion provided on the rotation unit, the protrusion provided on an inner circumference surface of the cylinder in the shield shell, the protrusion in movement along the guide groove when the holder is attached to the cylinder of the shield shell such that the holder rotates in the circumferential direction of the cylinder.

5. The shield unit according to claim 1, wherein the cylinder is made of an insulating material.

6. The shield unit according to claim 1, wherein the braid is formed into a tubal shape by a plurality of woven conductors made of a conductive material.

7. The shield unit according to claim 1, wherein the braid is electrically connected to the shield shell so as to form a shield circuit that prevents noise from entering or leaking from the electric wire.

8. The shield unit according to claim 1, wherein the holder is made of an insulating material.

9. The shield unit according to claim 1, wherein the rotation unit comprises:

two guide grooves; and two protrusions provided on an inner circumference surface of the cylinder of the shield shell, the two protrusions provided at the same intervals in the circumferential direction of a circumference circle, and protruding from the inner circumference surface of the cylinder, the two protrusions being inserted in the two guide grooves when the holder is inserted in the cylinder.

10. The shield unit according to claim 1, wherein the holder comprises handles formed on the holder.

11. The shield unit according to claim 1, wherein the rotation unit comprises:

two guide grooves; and two protrusions provided on an outer circumference surface of the cylinder of the shield shell, the two protrusions provided at the same intervals in the circumferential direction of a circumference circle, and protruding from the outer circumference surface of the cylinder, the two protrusions being inserted in the two guide grooves when the holder is inserted in the cylinder.

12. The shield unit according to claim 11, wherein the two guide grooves are formed into a symmetrical shape and are inclined in an attachment direction in which the holder is attached.

13. A shield unit comprising:

a shield shell having a cylinder into which an electric wire is inserted;

a braid having a contact portion arranged in contact with the cylinder;

a holder inserted in the cylinder and attached to the cylinder in contact with the contact portion, the holder attached to the cylinder electrically connecting the shield shell to the braid; and a rotation unit provided between the cylinder and the holder, the rotation unit being configured to make the holder rotate in a circumferential direction of the cylinder and make the cylinder and the contact portion slide relatively to each other until completion of attaching the holder to the cylinder, wherein the holder comprises:

an insertion portion inserted in the cylinder in contact with the contact portion; and an outer tube arranged at an outer circumference of the insertion portion and defining an attachment groove with the insertion portion in a radial direction of the outer tube and the insertion portion, the cylinder being inserted in the attachment groove, and the rotation unit comprises:

a guide groove provided in the outer tube; and a protrusion provided on an outer circumference surface of the cylinder and being engageable with the guide groove, the protrusion in movement along the guide groove upon the holder being attached to the cylinder making the contact portion rotate in a circumferential direction of the cylinder and making the cylinder and the contact portion slide relatively to each other.

14. The shield unit according to claim 13, wherein a gap exists between an end of the cylinder and a bottom of the attachment groove in the attachment groove upon the completion of attaching the holder to the cylinder.

15. The shield unit according to claim 13, wherein the cylinder comprises an accommodating portion for accommodating the contact portion between the cylinder and the holder.

16. The shield unit according to claim 13, further comprising a handle formed on the holder for attachment.

17. A shield unit comprising:

a shield shell having a cylinder into which an electric wire is inserted;

a braid having a contact portion arranged in contact with the cylinder;

a holder inserted in the cylinder and attached to the cylinder in contact with the contact portion, the holder attached to the cylinder electrically connecting the shield shell to the braid; and a rotation unit provided between the cylinder and the holder, the rotation unit being configured to make the holder rotate in a circumferential direction of the cylinder and make the cylinder and the contact portion slide relatively to each other until completion of attaching the holder to the cylinder, wherein the contact portion includes a folded portion formed by folding an end of the braid, and the holder is inserted in the folded portion and attached to the cylinder.

18. The shield unit according to claim 17, wherein the cylinder comprises an inclined portion inclined such that a contact pressure between the cylinder and the folded portion exerted by the holder gradually increases toward a rear side of the cylinder in an attachment direction in which the holder is attached to the cylinder.

19. The shield unit according to claim 17, wherein the cylinder comprises an accommodating portion for accommodating the contact portion between the cylinder and the holder.

20. The shield unit according to claim 17, further comprising a handle formed on the holder for attachment.

* * * * *